US012680481B2

(12) United States Patent
Manton

(10) Patent No.: US 12,680,481 B2
(45) Date of Patent: Jul. 14, 2026

(54) ROCKER ARM SYSTEM FOR AN INTERNAL COMBUSTION ENGINE VALVETRAIN

(71) Applicant: Manton Pushrods, LLC, Lake Elsinore, CA (US)

(72) Inventor: Jordan Raymond Manton, Canyon Lake, CA (US)

(73) Assignee: Manton Pushrods, LLC, Lake Elsinore, CA (US)

( * ) Notice: Subject to any disclaimer, the term of this patent is extended or adjusted under 35 U.S.C. 154(b) by 0 days.

(21) Appl. No.: 19/260,886

(22) Filed: Jul. 7, 2025

(65) Prior Publication Data

US 2026/0015954 A1 Jan. 15, 2026

Related U.S. Application Data

(60) Provisional application No. 63/669,809, filed on Jul. 11, 2024.

(51) Int. Cl.
*F01L 1/18* (2006.01)

(52) U.S. Cl.
CPC ..... *F01L 1/182* (2013.01)

(58) Field of Classification Search
CPC ... F01L 1/053; F01L 1/18; F01L 1/181; F01L 1/182; F01L 1/185; F02F 1/38
See application file for complete search history.

(56) References Cited

U.S. PATENT DOCUMENTS

| | | | | |
|---|---|---|---|---|
| 5,095,861 | A * | 3/1992 | Dove, Jr. | F01L 1/181 74/519 |
| 5,596,958 | A * | 1/1997 | Miller | F01L 1/18 123/193.5 |
| 5,636,600 | A * | 6/1997 | Sweetland | F01L 1/183 123/90.22 |
| 8,087,391 | B2 * | 1/2012 | Tores | F02F 1/38 74/559 |
| 10,711,655 | B1 * | 7/2020 | Hattiangadi | F01L 1/24 |
| 2007/0227485 | A1 * | 10/2007 | Tores | F01L 1/182 123/90.39 |

* cited by examiner

*Primary Examiner* — Loren C Edwards
(74) *Attorney, Agent, or Firm* — Sisson & Banyas, Attorneys at Law LLC; Jeffrey J. Banyas

(57) ABSTRACT

A rocker arm system for an internal combustion engine valvetrain includes a base member, a first rocker arm, a second rocker arm, and a saddle. The base member includes a first tower having a first tower recess, a second tower having a plurality of saddle mounting holes, a third tower having a third tower recess, a first rocker gap between the first tower and the second tower, and a second rocker gap between the second tower and the third tower. Each rocker arm includes an arm with a shaft extending through a shaft hole in the arm. A first tower recess central axis and a third tower recess central axis form a first angle having a measurement in a range of between 0° and 25°. The saddle is configured to connect to the second tower by passing a plurality of fasteners through plurality of corresponding saddle through holes in the saddle and into a plurality of corresponding saddle mounting holes in the second tower.

20 Claims, 9 Drawing Sheets

ROCKER ARM SYSTEM FOR AN INTERNAL COMBUSTION ENGINE VALVETRAIN

CROSS REFERENCES AND PRIORITIES

This application claims priority from U.S. Provisional Application No. 63/669,809 filed on Jul. 11, 2024, the teachings of which are incorporated by reference herein in their entirety.

BACKGROUND

Internal combustion engines are used as the primary power plant for most modern vehicles. The internal combustion engine utilizes expansion of gases within a cylinder head wherein pistons, connecting rods, and a crank shaft convert a controlled explosion in a cylinder chamber into rotational movement. Control of the cylinder chamber is performed by sequential operation of intake and exhaust valves operated by a camshaft, cam follower (sometimes referred to as a lifter), push rod, and rocker arm for conducting air flow into and out of the cylinder chambers.

Two basic configurations of rocker arms are utilized. The first—commonly referred to as stud mounted rocker arms—include a threaded stud installed within the cylinder head. The rocker arm is connected to the threaded stud by passing the threaded stud through a hole in the rocker arm and securing the rocker arm to the stud with an adjustable fastener which allows for users to adjust the valve lash of the individual valve.

The second—commonly referred to as shaft mounted rocker arms—include a series of threaded holes in the cylinder head. A shaft about which the rocker arm pivots is bolted directly to the cylinder head—or in some instances bolted to a plate which is connected to the cylinder head.

One example of a shaft mounted rocker arm system is disclosed in U.S. Pat. No. 5,596,958 which discloses a rocker arm bridge support system for high performance engines. The bridge support system eliminates the compound geometry angular placement of valves with a rigid support structure using a common or segmented shaft for securing angular disposed rocker arms to accommodate the offset geometry. A bridge top secures the rocker arm shaft in a free floating manner by bolting of the bridge base directly to the cylinder head as well as the bridge top which is also bolted to the cylinder head by use of through apertures located in the bridge base. The invention includes the teachings of offset rocker arms mountable to the rocker arm shaft to accommodate the angular valve placement.

Shaft mounted rocker arms are considered more robust and better able to withstand the forces applied to them during operation of an internal combustion engine. However, issues remain with shaft mounted rocker arm. Most notably, shaft mounted rocker arms typically require one or more of the rocker arms to have a complex geometry in order to align with the pushrod and the valve to allow the rocker arm to actuate the valve. These complex geometries may include offset sections along the length of the rocker arm and/or angled end(s) of the rocker arm as illustrated in U.S. Pat. No. 5,596,958. These complex geometries result in inefficiencies during manufacturing and operation of the rocker arm, and result in a rocker arm which is more prone to breakage by the forces applied to them during operation of the internal combustion engine.

The need exists, therefore, for an improved shaft mounted rocker arm system which reduces or eliminates the issues associated with the complex rocker arm geometries found in existing shaft mounted rocker arm systems.

SUMMARY

Described herein is a rocker arm system for an internal combustion engine valvetrain. The rocker arm system includes a base member, a first rocker arm, a second rocker arm and a saddle.

The base member has a base upper surface, a base lower surface, and a plurality of base mounting holes extending from the base upper surface through the base lower surface. The base member further comprises a first tower, a second tower, a third tower, a first rocker gap, and a second rocker gap. The first tower extends from the base upper surface and has a first tower recess with at least a first rocker mounting hole disposed therein. The second tower extends from the base upper surface and has a plurality of saddle mounting holes disposed therein. The third tower extends from the base upper surface and has a third tower recess with at least a second rocker mounting hole disposed therein. The first rocker gap extends between the first tower and the second tower. The second rocker gap extends between the second tower and the third tower.

The first rocker arm includes a first arm and a first shaft. The first arm having a first arm proximal end, a first arm terminal end, and a first arm shaft hole extending through the first arm substantially perpendicular to a first line formed by connecting the first arm proximal end to the first arm terminal end. The first shaft extends through the first arm shaft hole and has a first shaft first end comprising a first shaft mounting hole.

The second rocker arm includes a second arm and a second shaft. The second arm having a second arm proximal end, a second arm terminal end, and a second arm shaft hole extending through the second arm substantially perpendicular to a second line formed by connecting the second arm proximal end to the second arm terminal end. The second shaft extends through the second arm shaft hole and has a second shaft second end comprising a second shaft mounting hole.

The saddle has a saddle upper surface, a saddle lower surface, a saddle recess formed in the saddle lower surface, and a plurality of saddle through holes passing from the saddle upper surface through the saddle lower surface.

A first tower recess central axis and a third tower recess central axis form a first angle having a measurement in a range of between 0° and 25°. A first fastener is configured to connect the first rocker arm to the first tower recess by passing through the first shaft mounting hole and fastening to the first rocker mounting hole. A second fastener is configured to connect the second rocker arm to the third tower recess by passing through the second shaft mounting hole and fastening to the second rocker mounting hole. A plurality of third fasteners are configured to connect the saddle to the second tower by passing each third fastener of the plurality of third fasteners through a saddle through hole of the plurality of saddle through holes and fastening to a saddle mounting hole of the plurality of saddle mounting holes.

In some embodiments, the plurality of saddle mounting holes may include three saddle mounting holes. In such embodiments, the plurality of saddle through holes may include three saddle through holes. In such embodiments, the plurality of third fasteners may include three third fasteners.

In certain embodiments, the first arm proximal end may not be offset from the first arm terminal end. In some embodiments, the second arm proximal end may not be offset from the second arm terminal end.

In some embodiments, the first arm proximal end may include a first pushrod seat. In certain embodiments, the second arm proximal end may include a second pushrod seat.

In certain embodiments, the first arm terminal end may include a first gap. A first roller may be connected to the first arm terminal end at the first gap. In some embodiments, the second arm terminal end may include a second gap. A second roller may be connected to the second arm terminal end at the second gap.

In some embodiments, the first shaft mounting hole may include a first countersunk portion. In certain embodiments, the second shaft mounting hole may include a second countersunk portion.

DETAILED DESCRIPTION

Described herein is a rocker arm system for an internal combustion engine valvetrain. Reference is made to the Figures in which, unless otherwise noted, like numbers refer to like structures. As described herein and in the claims, the following numbers refer to the following structures as noted in the Figures.

10 refers to a rocker arm system.
100 refers to a base member.
102 refers to a base upper surface.
104 refers to a base lower surface.
106 refers to a base mounting hole.
110 refers to a first tower.
112 refers to a first tower recess.
113 refers to a first tower recess central axis.
114 refers to a first rocker mounting hole.
120 refers to a second tower.
122 refers to a saddle mounting hole.
130 refers to a third tower.
132 refers to a third tower recess.
133 refers to a third tower recess central axis.
134 refers to a second rocker mounting hole.
140 refers to a first rocker gap.
150 refers to a second rocker gap.
200 refers to a first rocker arm.
210 refers to a first arm.
211 refers to a first arm proximal end.
212 refers to a first arm terminal end.
213 refers to a first pushrod seat.
214 refers to a first gap.
215 refers to a first arm shaft hole.
216 refers to a first roller.
218 refers to a first line.
220 refers to a first shaft.
221 refers to a first shaft first end.
222 refers to a first shaft mounting hole.
223 refers to a first countersunk portion.
230 refers to a first fastener.
300 refers to a second rocker arm.
310 refers to a second arm.
311 refers to a second arm proximal end.
312 refers to a second arm terminal end.
313 refers to a second pushrod seat.
314 refers to a second gap.
315 refers to a second arm shaft hole.
316 refers to a second roller.
318 refers to a second line.
320 refers to a second shaft.
321 refers to a second shaft second end.
322 refers to a second shaft mounting hole.
323 refers to a second countersunk portion.
330 refers to a second fastener.
400 refers to a saddle.
410 refers to a saddle upper surface.
420 refers to a saddle lower surface.
430 refers to a saddle recess.
440 refers to a saddle through hole.
450 refers to a third fastener.

Figure 1:
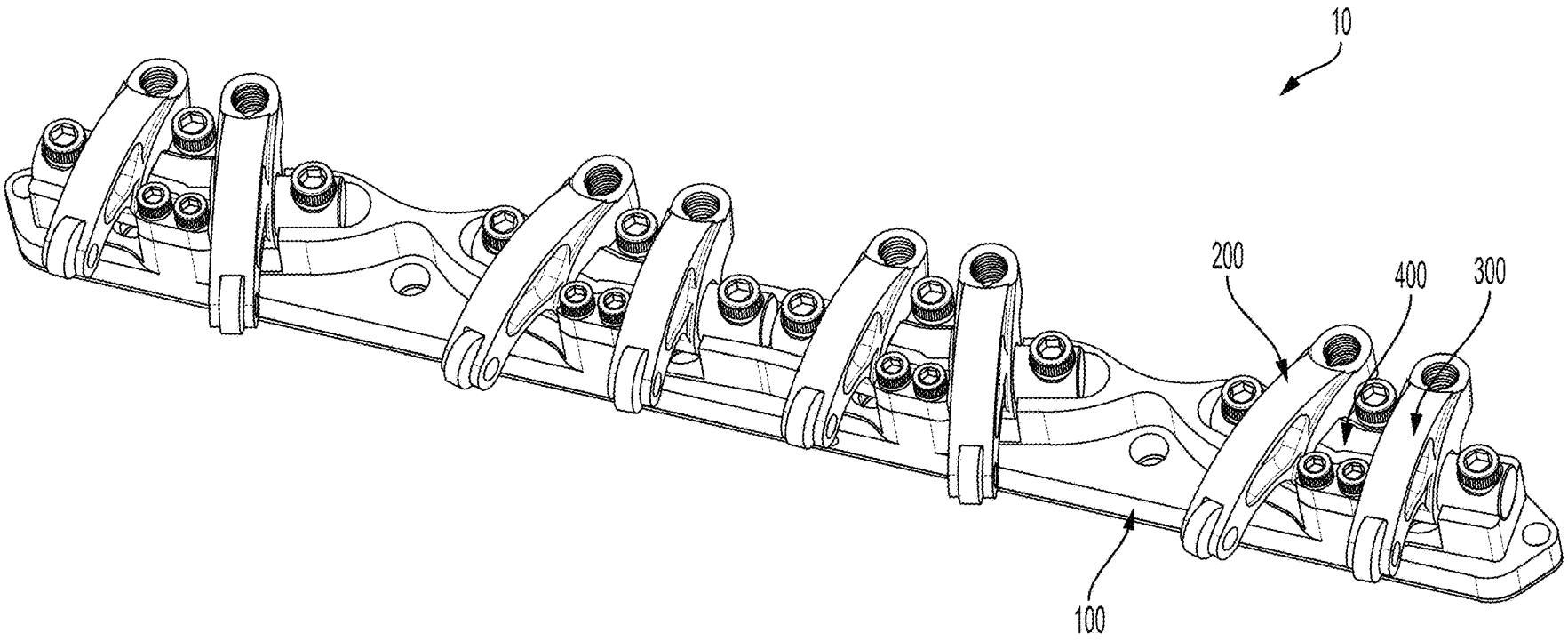
FIG. 1 is a perspective view of a rocker arm system.

FIG. 1 illustrates a perspective view of an exemplary embodiment of a rocker arm system (10) in assembled form. As shown in FIG. 1, the rocker arm system includes a base member (100), at least a first rocker arm (200) and a second rocker arm (300), and a saddle (400).

Figure 2:
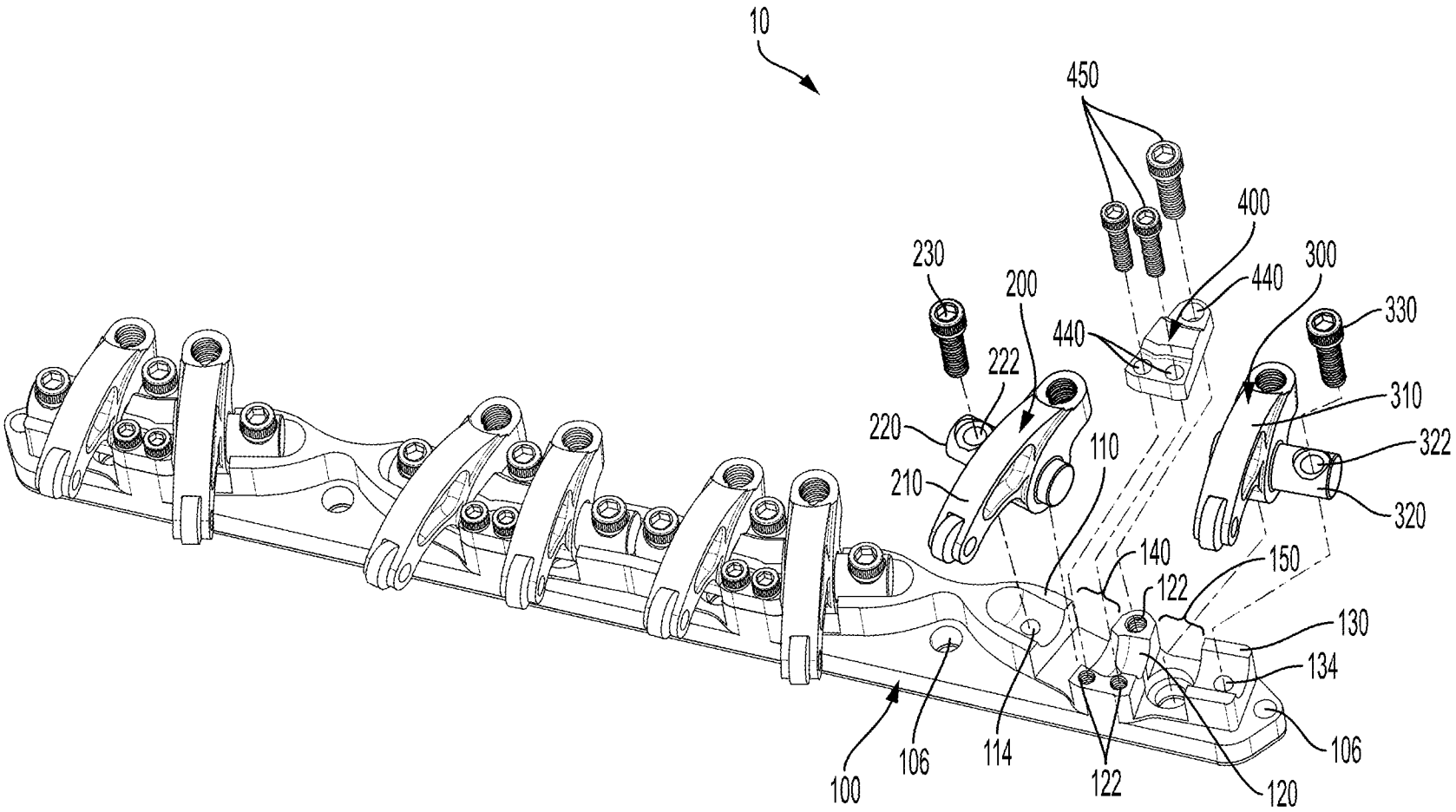
FIG. 2 is an exploded perspective view of a rocker arm system.

FIG. 2 illustrates a partially exploded perspective view of the exemplary embodiment of a rocker arm system (10) from FIG. 1 including additional details of the base member (100), the first rocker arm (200), the second rocker arm (300), and the saddle (400). As shown in FIG. 2, the base member includes a first tower (110), a second tower (120), a third tower (130), a first rocker gap (140), and a second rocker gap (150). The first rocker gap extending between the first tower and the second tower with the second rocker gap extending between the second tower and the third tower.

Each of the rocker arms includes an arm and a shaft. For example, as shown in FIG. 2, the first rocker arm (200) includes a first arm (210) and a first shaft (220). Similarly, the second rocker arm (300) includes a second arm (310) and a second shaft (320).

The saddle (400) includes a plurality of saddle through holes (440) as shown in FIG. 2. The number and location of saddle through holes is not considered important. In general, the number of saddle through holes may be an integer in the range of between two and ten. In the embodiment shown in FIG. 2, the saddle includes three saddle through holes.

Figure 3:
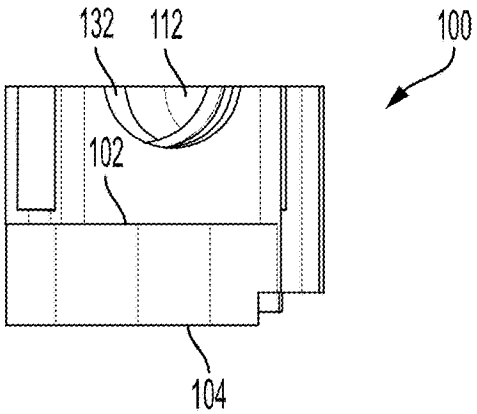
FIG. 3 is a side view of a base member for a rocker arm system.
Figure 4:
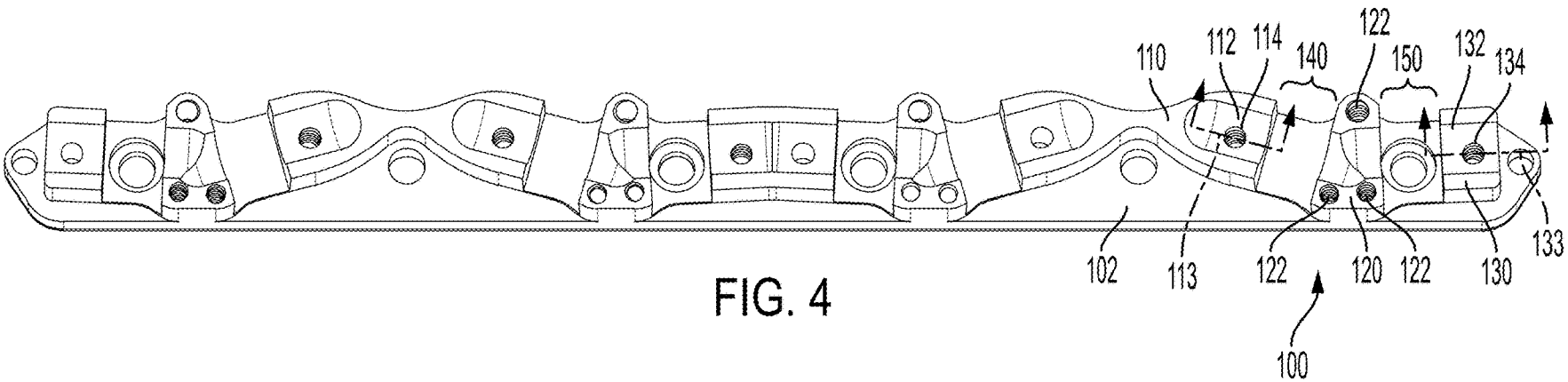
FIG. 4 is a perspective top view of a base member for a rocker arm system.

FIG. 3 and FIG. 4 show an exemplary embodiment of a base member (100) with FIG. 3 illustrating the base member from the side and FIG. 4 illustrating the base member from the top. As shown in FIG. 3, the base member includes a base upper surface (102) and a base lower surface (104). A plurality of base mounting holes ((106) as shown in FIG. 2) extend from the base upper surface through the base lower surface. These base mounting holes may be configured to receive a fastener—such as a bolt or a stud with a nut—to attach the base member to a cylinder head (not shown) of an internal combustion engine.

The first tower (110) extends upwardly from the base upper surface and includes a first tower recess (112). Preferably, the first tower recess will include at least a first rocker mounting hole (114) extending into—but not necessarily through—the first tower recess. The first rocker mounting hole being configured to receive a first fastener ((230) as shown in FIG. 2) to connect a portion of the first rocker arm ((200) as shown in FIG. 2) to the base member (100) when the first rocker arm is positioned within the first rocker gap (140). The first fastener may be of any number of conventional configurations such as a bolt having a bolt head which may be a hex head, an alan head (as shown in the Figures) or the like. Alternatively, the first fastener may be a stud with a nut that fastens to the stud.

The second tower (120) extends upwardly from the base upper surface (102) and includes a plurality of saddle mounting holes (122) disposed therein. The plurality of saddle mounting holes being configured to receive a third fastener ((450) as shown in FIG. 2) to connect the saddle ((400) as shown in FIG. 2) to the base member (100) and hold each of the first rocker arm ((200) as shown in FIG. 2) and the second rocker arm ((300) as shown in FIG. 2) in place. The number and location of saddle mounting holes should correspond to the number of saddle through holes ((440) as shown in FIG. 2) in the saddle. Accordingly, like the saddle through holes, the number of saddle mounting holes may be an integer in the range of between two and ten. In the embodiment shown in FIG. 4, the second tower includes three saddle mounting holes.

The third tower (130) extends upwardly from the base upper surface (102) and includes a third tower recess (132). Preferably, the third tower recess will include at least a second rocker mounting hole (134) extending into—but not necessarily through—the third tower recess. The second rocker mounting hole being configured to receive a second fastener ((330) as shown in FIG. 2) to connect a portion of the second rocker arm ((300) as shown in FIG. 2) to the base member (100) when the second rocker arm is positioned within the second rocker gap (150). The second fastener may be of any number of conventional configurations such as a bolt having a bolt head which may be a hex head, an alan head (as shown in the Figures) or the like. Alternatively, the second fastener may be a stud with a nut that fastens to the stud.

Figure 5:
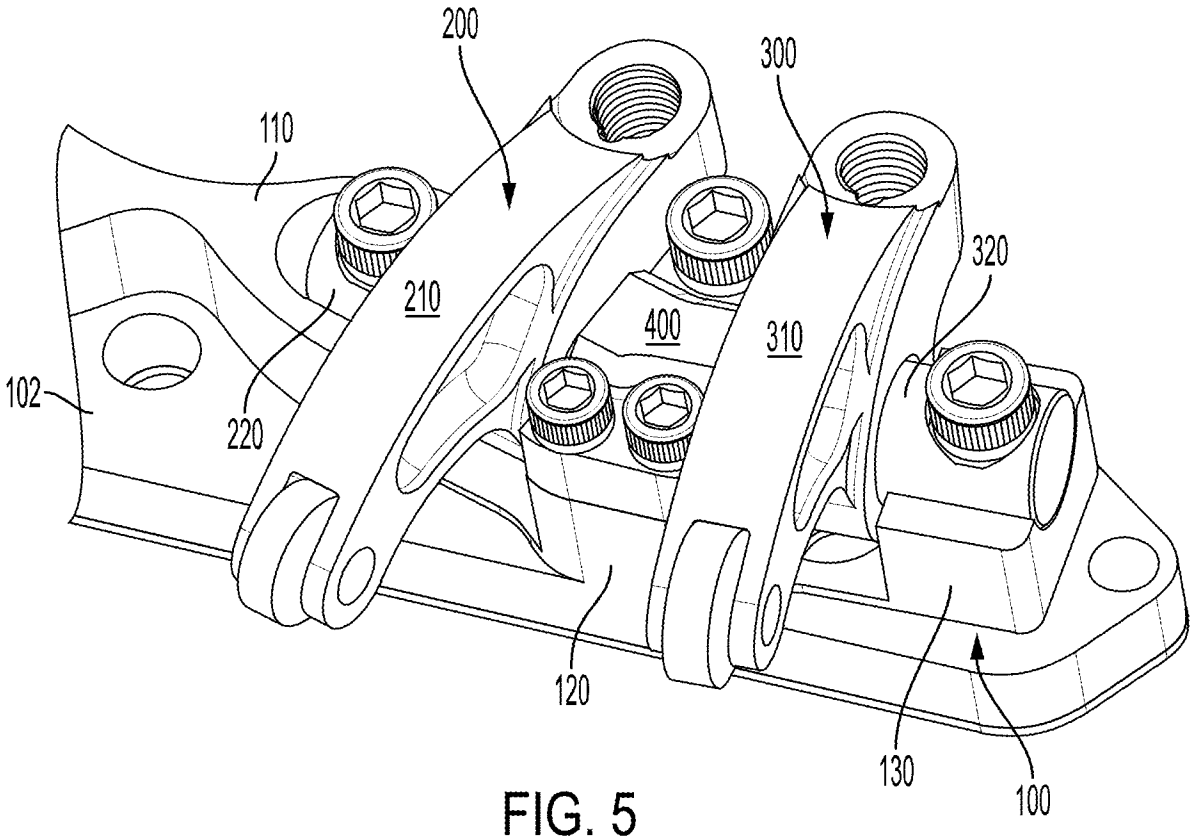
FIG. 5 is a perspective view of a pair of rocker arms.

As shown in FIG. 4, the first tower recess (112) includes a first tower recess central axis (113) while the third tower recess (132) includes a third tower recess central axis (133). The first tower recess central axis and the third tower recess central axis form a first angle measured clockwise from the third tower recess central axis to the first tower recess central axis which allows for the first rocker arm (200) to be angled relative to the second rocker arm (300) when the first rocker arm and the second rocker arm are connected to the base as shown in FIG. 5. A measurement of the first angle may be in a range selected from the group consisting of between 0° and 25°, between 0° and 20°, between 0° and 15°, between 0° and 10°, between 2° and 25°, between 2° and 20°, between 2° and 15°, between 2° and 10°, between 5° and 25°, between 5° and 20°, and between 5° and 15°.

Angling the first rocker arm (200) relative to the second rocker arm (300) by way of the first angle formed between the first tower recess central axis (113) and the third tower recess central axis (133) allows both the first arm (210) of the first rocker arm and the second arm (310) of the second rocker arm to have a relatively straight profile as opposed to offsetting one or both of the first arm and/or the second arm. Preferably, the first arm proximal end (211) will not be offset from the first arm terminal end (212), and/or the second arm proximal end (311) will not be offset from the second arm terminal end (312). At the same time, the first arm proximal end may still engage properly with a pushrod while the first arm terminal end engages properly with a tip of the corresponding valve to allow the first rocker arm to actuate said valve when driven by a camshaft reciprocating the pushrod. Correspondingly, the second arm proximal end engages properly with a pushrod while the second arm terminal end engages properly with a tip of the corresponding valve to allow the second rocker arm to actuate said valve when driven by a camshaft reciprocating the pushrod.

FIG. 5 illustrates a perspective view of a single pair of rocker arms connected to a base member (100). The single pair of rocker arms are such that one rocker arm of the pair is configured to actuate an intake valve of one cylinder of an internal combustion engine while the other rocker arm of the pair is configured to actuate an exhaust valve of the same cylinder of an internal combustion engine. While FIG. 6 illustrates rocker arms for a single cylinder of an internal combustion engine, one of ordinary skill will recognize that the configuration may apply to engines having multiple cylinders such as is shown in FIG. 1—in which case each cylinder may have its own pair of rocker arms configured to actuate that cylinder's individual intake and exhaust valves.

Figure 6:
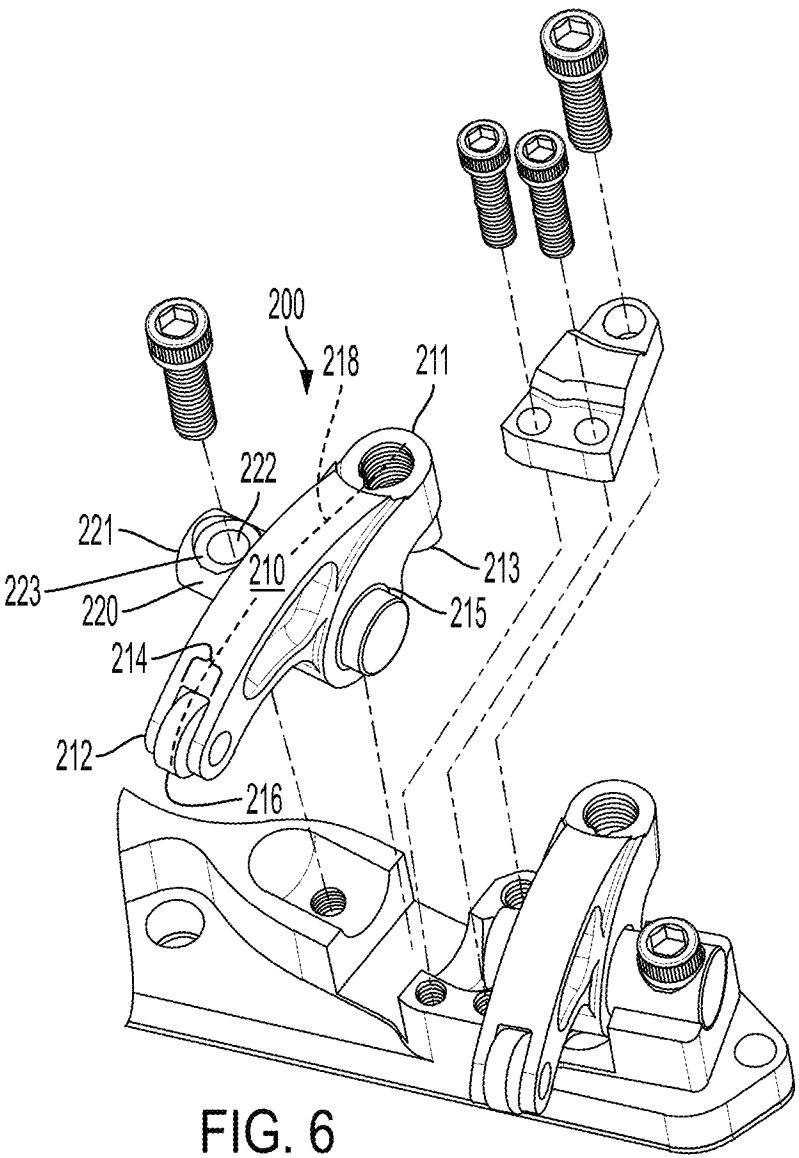
FIG. 6 is an exploded view of a first rocker arm.

FIG. 6 illustrates an exploded perspective view of an exemplary embodiment of a first rocker arm (200). As shown in FIG. 6, the first rocker arm includes a first arm (210) and a first shaft (220). The first arm includes a first arm proximal end (211) and a first arm terminal end (212). Extending through the first arm is a first arm shaft hole (215). Preferably, a central axis of the first arm shaft hole will be substantially perpendicular to or perpendicular to a first line (218) formed by connecting a center point of the first arm proximal end to a center point of the first arm terminal end. The first shaft extends through the first arm shaft hole and includes a first shaft mounting hole (222) at a first shaft first end (221). The first shaft mounting hole is a through hole allowing a first fastener ((230) as shown in FIG. 2) to pass through the first shaft for attachment to the first rocker mounting hole ((114) as shown in FIG. 4) to connect the first rocker arm to the base member ((100) as shown in FIG. 2). In some embodiments, the first shaft mounting hole may include a first countersunk portion (223) within which the head of the first fastener may be disposed.

In certain embodiments, the first arm proximal end (211) may include a first pushrod seat (213) on a lower surface thereof. When present, the first pushrod seat provides a concave or convex surface against which an end of a pushrod (not shown) may be disposed. As the pushrod moves up and down driven by the motion of a camshaft (not shown) the end of the pushrod forces the first arm (210) to pivot about the first shaft (220). In some embodiments, a valve lash adjuster may pass into a threaded hole above the pushrod seat and abut against the pushrod seat allowing a user to manually adjust the valve lash of the individual rocker arm.

In some embodiments, the first arm terminal end (212) may include a first gap (214) with a first roller (216) positioned within the first gap and connected to the first arm terminal end by a bolt, pin, or similar device. When present, the first roller provides a reduced friction surface against which the tip of the corresponding valve (not shown)—with or without a lash cap (not shown)—may rest.

Figure 7:
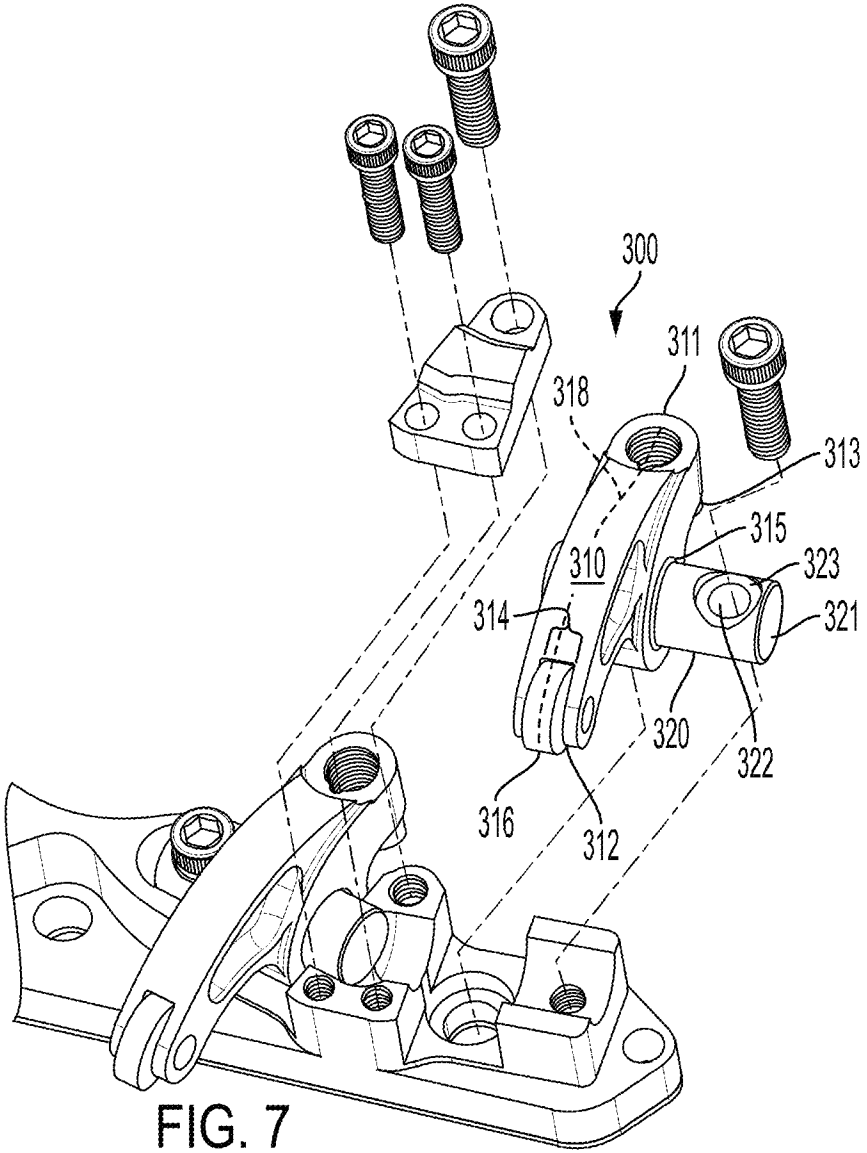
FIG. 7 is an exploded view of a second rocker arm.

FIG. 7 illustrates an exploded perspective view of an exemplary embodiment of a second rocker arm (300) which may be of similar or even identical construction to the first rocker arm (200). As shown in FIG. 7, the second rocker arm includes a second arm (310) and a second shaft (320). The second arm includes a second arm proximal end (311) and a second arm terminal end (312). Extending through the second arm is a second arm shaft hole (315). Preferably, a central axis of the second arm shaft hole will be substantially perpendicular to or perpendicular to a second line (318) formed by connecting a center point of the second arm proximal end to a center point of the second arm terminal end. The second shaft extends through the second arm shaft hole and includes a second shaft mounting hole (322) at a second shaft second end (321). The second shaft mounting hole is a through hole allowing a second fastener ((330) as shown in FIG. 2) to pass through the second shaft for attachment to the second rocker mounting hole ((134) as shown in FIG. 4) to connect the second rocker arm to the base member ((100) as shown in FIG. 2). In some embodiments, the second shaft mounting hole may include a second countersunk portion (323) within which the head of the second fastener may be disposed.

In certain embodiments, the second arm proximal end (311) may include a second pushrod seat (313) on a lower surface thereof. When present, the second pushrod seat provides a concave or convex surface against which an end of a pushrod (not shown) may be disposed. As the pushrod moves up and down driven by the motion of a camshaft (not shown) the end of the pushrod forces the second arm (310) to pivot about the second shaft (320). In some embodiments, a valve lash adjuster may pass into a threaded hole above the pushrod seat and abut against the pushrod seat allowing a user to manually adjust the valve lash of the individual rocker arm.

In some embodiments, the second arm terminal end (312) may include a second gap (314) with a second roller (316) positioned within the second gap and connected to the second arm terminal end by a bolt, pin, or similar device. When present, the second roller provides a reduced friction surface against which the tip of the corresponding valve (not shown)—with or without a lash cap (not shown)—may rest.

Figure 8B:
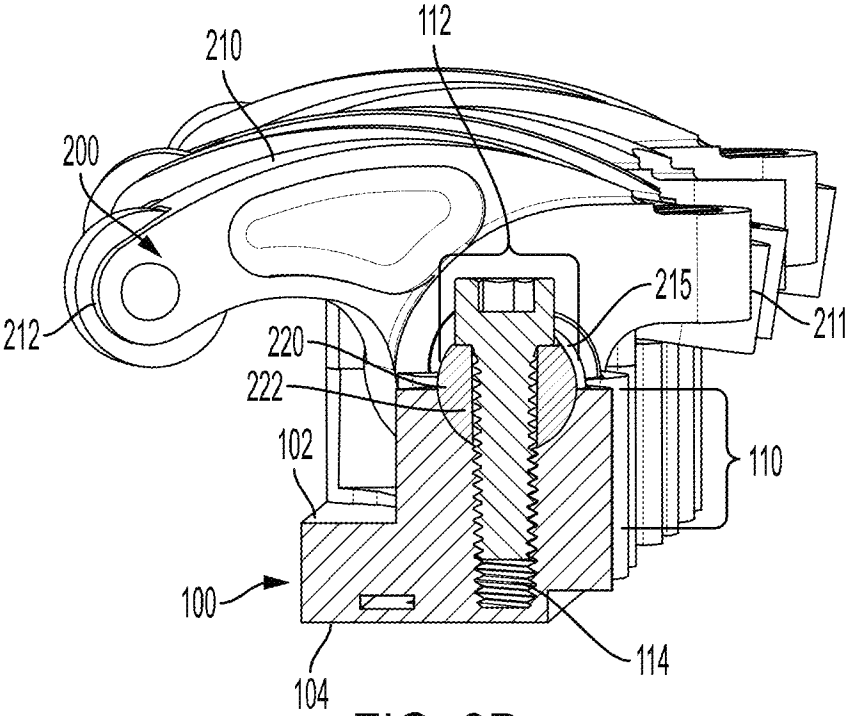
FIG. 8B is a cross section view of a portion of a rocker arm system.
Figure 8A:
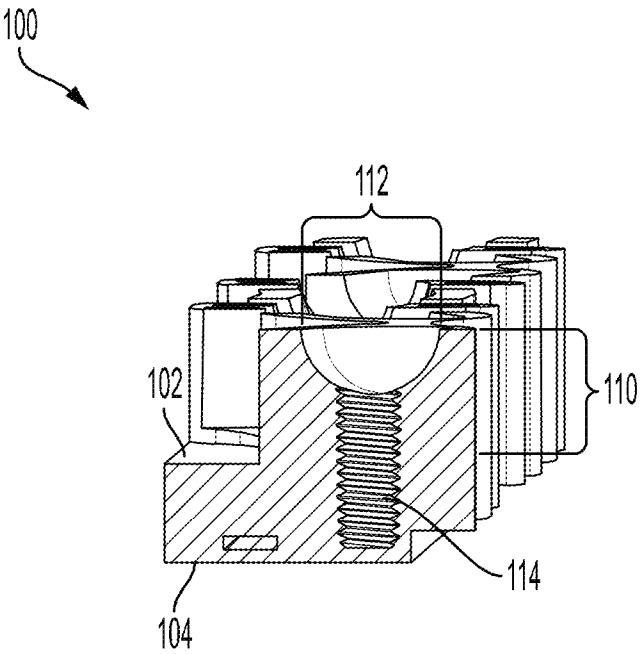
FIG. 8A is a cross section view of a portion of a base member for a rocker arm system.

FIG. 8A and FIG. 8B illustrate cross section views of a portion of the rocker arm system ((10) as shown in FIG. 1) taken at the first tower recess (112) with FIG. 8A illustrating a cross section of the base member (100) and FIG. 8B illustrating the first rocker arm (200) connected to the base member. As shown in FIG. 8A, the first tower recess of the first tower (110) may form a substantially concave surface while the first shaft (220) of the first rocker arm includes a substantially convex surface of similar dimensions to the concave surface of the first tower recess. This allows the first shaft to nest within the first tower recess. The first fastener ((230) as shown in FIG. 2) then passes through the first shaft mounting hole (222) and into the first rocker mounting hole (114) to secure at least a portion of the first shaft to the first tower. In the embodiment shown in the Figures, the first fastener is in the form of a bolt. However, other first fastener embodiments—such as a stud threaded into and extending from the first rocker mounting hole with a nut threaded onto the stud to secure the first shaft to the first tower—may exist.

Figure 9B:
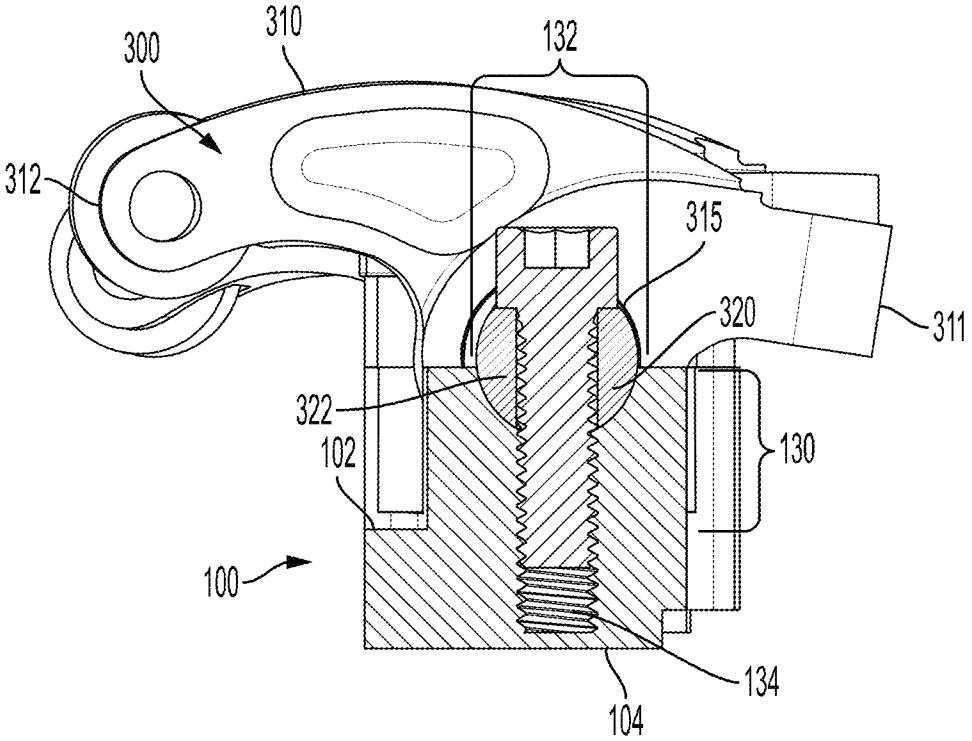
FIG. 9B is a cross section view of a portion of a rocker arm system.
Figure 9A:
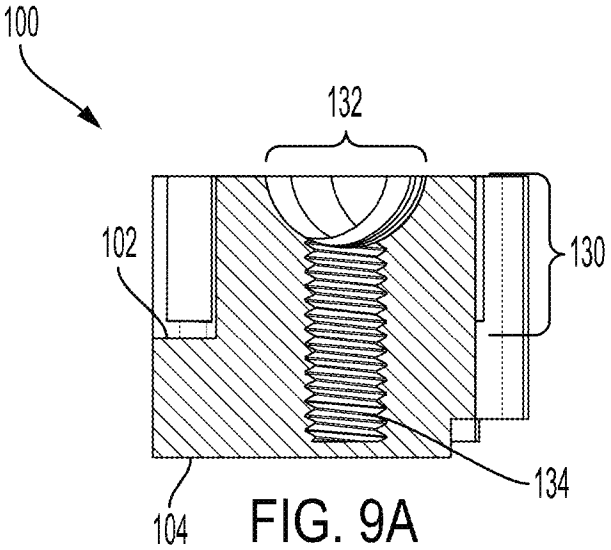
FIG. 9A is cross section view of a portion of a base member for a rocker arm system.

FIG. 9A and FIG. 9B illustrate cross section views of a portion of the rocker arm system ((10) as shown in FIG. 1) taken at the third tower recess (132) with FIG. 9A illustrating a cross section of the base member (100) and FIG. 9B illustrating the second rocker arm (300) connected to the base member. As shown in FIG. 9A, the third tower recess of the third tower (130) may form a substantially concave surface while the second shaft (320) of the second rocker arm includes a substantially convex surface of similar dimensions to the concave surface of the third tower recess. This allows the second shaft to nest within the third tower recess. The second fastener ((330) as shown in FIG. 2) then passes through the second shaft mounting hole (322) and into the second rocker mounting hole (134) to secure at least a portion of the second shaft to the third tower. In the embodiment shown in the Figures, the second fastener is in the form of a bolt. However, other second fastener embodiments—such as a stud threaded into and extending from the second rocker mounting hole with a nut threaded onto the stud to secure the second shaft to the third tower—may exist.

Figure 10A:
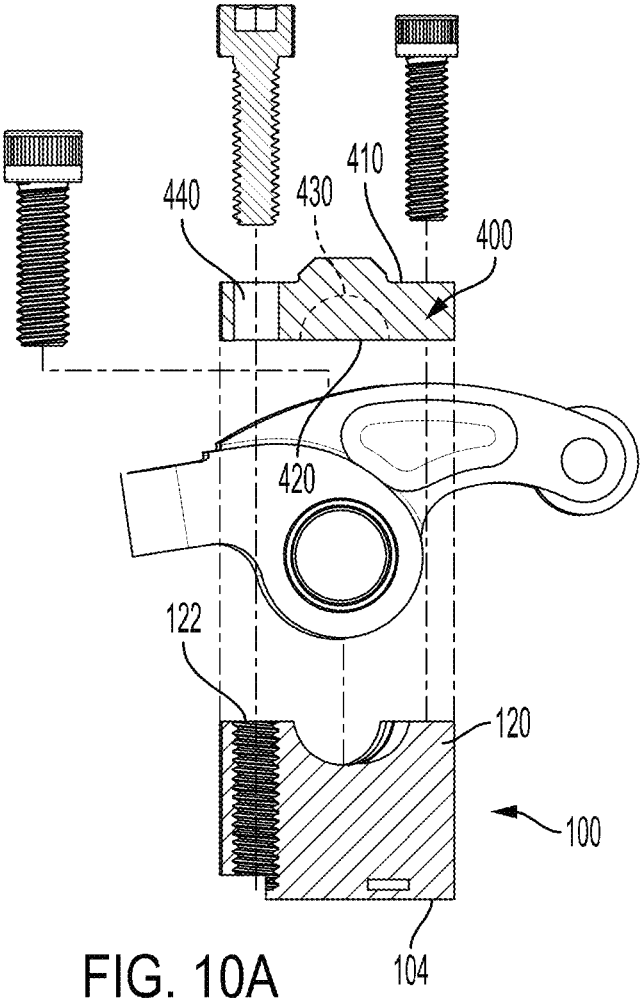
FIG. 10A is an exploded cross section view of a portion of a base member and a saddle for a rocker arm system.
Figure 10B:
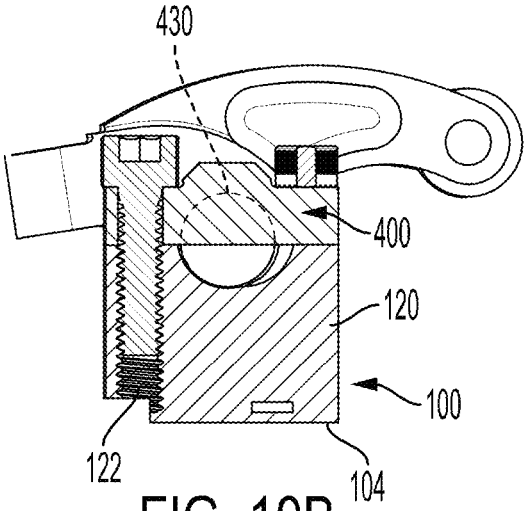
FIG. 10B is an assembled cross section view of a portion of a base member and a saddle for a rocker arm system.

FIG. 10A and FIG. 10B illustrate cross section view of a portion of the rocker arm system ((10) as shown in FIG. 1) taken at the second tower (120) with FIG. 10A illustrating an exploded cross section of the base member (100) and the saddle (400) and FIG. 10B illustrating an assembled version thereof. As shown in FIG. 10A, the second tower includes a pair of concave recesses—one of which is oriented to receive a convex surface of a portion of the first shaft ((220) as shown in FIG. 2) of the first rocker arm ((200) as shown in FIG. 2) while the other is oriented to receive a convex surface of the second shaft ((320) as shown in FIG. 2) of the second rocker arm ((300) as shown in FIG. 2). Correspondingly, a bottom side of the saddle includes a pair of concave surfaces configured to fit over and around convex surfaces of the portion of the first shaft and the second shaft which are disposed into the concave recesses of the second tower.

As shown in FIG. 10A and FIG. 10B, the saddle mounting hole(s) (122) pass into—but not necessarily through—the second tower (120). The saddle through hole(s) (440) pass all the way through the saddle (400). The saddle is placed onto the second tower with the concave surfaces in the saddle being disposed over the corresponding convex surfaces of the portion of the first shaft ((220) as shown in FIG. 2) and the second shaft ((320) as shown in FIG. 2). The third fastener(s) (450) then individually pass through one of the saddle through holes and into the saddle mounting holes to secure the saddle to the second tower and hold a portion of the first rocker arm ((200) as shown in FIG. 2) and the second rocker arm ((300) as shown in FIG. 2) in place. In the embodiment shown in the Figures, the third fastener is in the form of a bolt. However, other third fastener embodiments—such as a stud threaded into and extending from a saddle mounting hole with a nut threaded onto the stud to secure the saddle to the second tower—may exist.

As shown in the Figures, the rocker arm systems disclosed herein allow for the shaft mounted rocker arm to have a simple geometry without offsets and/or angled ends. It is believed that the relatively simple geometry of these shaft mounted rocker arms produces a more efficient movement of the rocker arm during operation and is less prone to breakage by the forces applied to the rocker arm during operation of the internal combustion engine.

While the rocker arm system has been described as having one or more exemplary designs, the present article may be further modified within the spirit and scope of this disclosure. This application is therefore intended to cover any variations, uses, or adaptations of the rocker arm system using their general principles.

What is claimed is:

1. A rocker arm system (10) for an internal combustion engine valvetrain comprising:

a base member (100) having a base upper surface (102), a base lower surface (104), and a plurality of base mounting holes (106) extending from the base upper surface through the base lower surface, said base member comprising:

a first tower (110) extending from the base upper surface and having a first tower recess (112) with at least one first rocker mounting hole (114) disposed therein;

a second tower (120) extending from the base upper surface and having a plurality of saddle mounting holes (122) disposed therein;

a third tower (130) extending from the base upper surface and having a third tower recess (132) with at least a second rocker mounting hole (134) disposed therein;

a first rocker gap (140) extending between the first tower and the second tower; and a second rocker gap (150) extending between the second tower and the third tower;

a first rocker arm (200) comprising:

a first arm (210) having a first arm proximal end (211), a first arm terminal end (212), and a first arm shaft hole (215) extending through the first arm substantially perpendicular to a first line (218) formed by connecting the first arm proximal end to the first arm terminal end; and a first shaft (220) extending through the first arm shaft hole and having a first shaft first end (221) comprising a first shaft mounting hole (222);

a second rocker arm (300) comprising:

a second arm (310) having a second arm proximal end (311), a second arm terminal end (312), and a second arm shaft hole (315) extending through the second arm substantially perpendicular to a second line (318) formed by connecting the second arm proximal end to the second arm terminal end; and a second shaft (320) extending through the second arm shaft hole and having a second shaft second end (321) comprising a second shaft mounting hole (322); and a saddle (400) having a saddle upper surface (410), a saddle lower surface (420), a saddle recess (430) formed in the saddle lower surface, and a plurality of saddle through holes (440) passing from the saddle upper surface through the saddle lower surface; and wherein a first tower recess central axis (113) and a third tower recess central axis (133) form a first angle having a measurement in a range of between 0° and 25°, a first fastener (230) is configured to connect the first rocker arm to the first tower recess by passing through the first shaft mounting hole and fastening to the first rocker mounting hole, a second fastener (330) is configured to connect the second rocker arm to the third tower recess by passing through the second shaft mounting hole and fastening to the second rocker mounting hole, and a plurality of third fasteners (450) are configured to connect the saddle to the second tower by passing each third fastener of the plurality of third fasteners through a saddle through hole of the plurality of saddle through holes and fastening to a saddle mounting hole of the plurality of saddle mounting holes.

2. The rocker arm system of claim 1, wherein the plurality of saddle mounting holes includes three saddle mounting holes, the plurality of saddle through holes includes three saddle through holes, and the plurality of third fasteners includes three third fasteners.

3. The rocker arm system of claim 2, wherein the first arm proximal end is not offset from the first arm terminal end.

4. The rocker arm system of claim 3, wherein the second arm proximal end is not offset from the second arm terminal end.

5. The rocker arm system of claim 4, wherein the first arm proximal end includes a first pushrod seat (213).

6. The rocker arm system of claim 5, wherein the second arm proximal end includes a second pushrod seat (313).

7. The rocker arm system of claim 4, wherein the second arm proximal end includes a second pushrod seat (313).

8. The rocker arm system of claim 4, wherein the first arm terminal end includes a first gap (214) with a first roller (216) connected to the first arm terminal end at the first gap.

9. The rocker arm system of claim 8, wherein the second arm terminal end includes a second gap (314) with a second roller (310) connected to the second arm terminal end at the second gap.

10. The rocker arm system of claim 4, wherein the second arm terminal end includes a second gap (314) with a second roller (316) connected to the second arm terminal end at the second gap.

11. The rocker arm system of claim 2, wherein the second arm proximal end is not offset from the second arm terminal end.

12. The rocker arm system of claim 1, wherein the first arm proximal end is not offset from the first arm terminal end.

13. The rocker arm system of claim 12, wherein the second arm proximal end is not offset from the second arm terminal end.

14. The rocker arm system of claim 1, wherein the second arm proximal end is not offset from the second arm terminal end.

15. The rocker arm system of claim 1, wherein the first arm proximal end includes a first pushrod seat (213).

16. The rocker arm system of claim 1, wherein the second arm proximal end includes a second pushrod seat (313).

17. The rocker arm system of claim 1, wherein the first arm terminal end includes a first gap (214) with a first roller (216) connected to the first arm terminal end at the first gap.

18. The rocker arm system of claim 1, wherein the second arm terminal end includes a second gap (314) with a second roller (316) connected to the second arm terminal end at the second gap.

19. The rocker arm system of claim 1, wherein the first shaft mounting hole includes a first countersunk portion (223).

20. The rocker arm system of claim 1, wherein the second shaft mounting hole includes a second countersunk portion (323).

* * * * *